US006789405B1

(12) United States Patent
Mathers

(10) Patent No.: US 6,789,405 B1
(45) Date of Patent: Sep. 14, 2004

(54) TROLLING MOTOR ANTI-THEFT DEVICE

(76) Inventor: Robert Mathers, 9411 SW. 185 Ter., Miami, FL (US) 33157

( * ) Notice: Subject to any disclaimer, the term of this patent is extended or adjusted under 35 U.S.C. 154(b) by 0 days.

(21) Appl. No.: 10/441,075

(22) Filed: May 20, 2003

(51) Int. Cl.[7] ..... E05B 73/00
(52) U.S. Cl. ..... 70/14; 70/18; 70/58; 70/232
(58) Field of Search ..... 70/2, 14, 18, 19, 70/58, 232, 158–169, 181, 182

(56) References Cited

U.S. PATENT DOCUMENTS

| | | | | | |
|---|---|---|---|---|---|
| 2,883,850 | A | * | 4/1959 | Falck | 70/431 |
| 3,391,555 | A | * | 7/1968 | Mamo | 70/258 |
| 3,678,717 | A | * | 7/1972 | Eaton | 70/232 |
| 4,296,615 | A | | 10/1981 | Zoor | 70/19 |
| 4,325,701 | A | | 4/1982 | Peters, II et al. | 70/163 X |
| 4,407,146 | A | * | 10/1983 | Nielsen, Jr. | 70/232 |
| 4,502,306 | A | | 3/1985 | Scammacca | 70/159 |
| 4,683,728 | A | * | 8/1987 | Hailey | 70/14 |
| 4,715,783 | A | * | 12/1987 | Wade | 416/146 R |
| 4,736,603 | A | | 4/1988 | Brushaber | 70/232 |
| 5,184,488 | A | * | 2/1993 | Sandlin | 70/14 |
| 5,309,742 | A | * | 5/1994 | Lawrence | 70/232 |
| 5,469,721 | A | | 11/1995 | Pyle | 70/14 |
| 5,503,578 | A | * | 4/1996 | Cestaro | 440/83 |
| 5,638,705 | A | | 6/1997 | Buescher et al. | 70/14 |
| 5,794,462 | A | * | 8/1998 | Steele et al. | 70/18 |
| 5,884,509 | A | | 3/1999 | LeBoeuf | 70/18 |
| 6,202,453 | B1 | * | 3/2001 | Disher et al. | 70/14 |
| 6,283,806 | B1 | | 9/2001 | Schmidt et al. | 440/53 |
| 6,427,496 | B1 | * | 8/2002 | Hurst | 70/14 |
| 2001/0001926 | A1 | | 5/2001 | Edmondson | 70/58 |

FOREIGN PATENT DOCUMENTS

| | | |
|---|---|---|
| GB | 2 334 995 A | 8/1999 |

* cited by examiner

*Primary Examiner*—Suzanne Dino Barrett
(74) *Attorney, Agent, or Firm*—Richard C. Litman

(57) ABSTRACT

An anti-theft device for deterring unauthorized removal of an electric trolling motor from a vessel. The device is adapted to secure a trolling motor's control shaft and motor assembly to the trolling motor mount or directly to the vessel. The device includes only a clevis pin, a clevis and a padlock, the device is compact in design and easy to use. A uniquely designed hasp is employed in some instances to accomplish proper attachment of the anti-theft device. The hasp is secured directly to the hull or deck of the vessel.

3 Claims, 6 Drawing Sheets

TROLLING MOTOR ANTI-THEFT DEVICE

BACKGROUND OF THE INVENTION

1. Field of the Invention

The present invention generally relates to accessories for boats. More specifically, the present invention is drawn to an anti-theft device for securing a trolling motor to a boat.

2. Description of the Related Art

Trolling motors are usually attached to the stern or bow of a boat and are utilized to propel the boats quietly and slowly around an area of water. Trolling motors are especially effective when navigating in shallow areas close to the shoreline. The quietness and efficiency of the trolling motor allows the fisherman to concentrate on what he enjoys most, catching fish.

Since the trolling motor is seldom employed as the primary means of propulsion, the motor is usually removed from the water when not in use and often stored on the deck of the boat. Unfortunately, this scenario sometimes results in theft of the trolling motor. An inexpensive, easy-to-use device that would function to deter unauthorized removal of a trolling motor from a vessel would certainly be a welcome addition to the art.

There are many patents in the boating art relating to anti-theft devices. For example, U.S. Patent Application numbered 2001/0001926 (Edmondson) shows an anti-theft device for securing boats to a dock.

U.S. Pat. No. 4,296,615 (Zoor) discloses pivotally connected half shells for securing a mast of a sailing craft.

U.S. Pat. No. 4,325,701 (Peters II, et al.), U.S. Pat. No. 4,502,306 (Scammacca), U.S. Pat. No. 4,736,603 (Brushaber), U.S. Pat. No. 5,884,509 (LeBoeuf), U.S. Pat. No. 5,469,721 (Pyle), U.S. Pat. No. 6,283,806 (Schmidt et al.) and United Kingdom Patent 2 334 995 A are drawn to structure for securing outboard-inboard propulsion systems.

U.S. Pat. No. 5,638,705 (Pyle) discloses anti-theft apparatus for a personal watercraft which is powered by a jet pump.

None of the above inventions and patents, taken either singly or in combination, is seen to disclose an anti-theft device for a trolling motor as will be subsequently described and claimed herein.

SUMMARY OF THE INVENTION

The instant invention is an anti-theft device for deterring unauthorized removal of an electric trolling motor from a vessel. The device is adapted to secure trolling motor's control shaft and motor assembly to the trolling motor mount or directly to the vessel. Consisting of only a clevis pin, a clevis and a padlock, the device is compact in design and easy to use. A uniquely designed hasp is employed in some instances to accomplish proper attachment of the anti-theft device. The hasp is secured directly to the hull or deck of the vessel.

Accordingly, it is a principal object of the invention to provide an anti-theft device for a trolling motor.

It is another object of the invention to provide an anti-theft device for a trolling motor, which device is adaptable to conventional trolling motor mounts.

It is a further object of the invention to provide an anti-theft device for a trolling motor, which device is compact in design and easy to use.

Still another object of the invention is to provide an anti-theft device for a trolling motor, which device is fabricated from rugged material.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
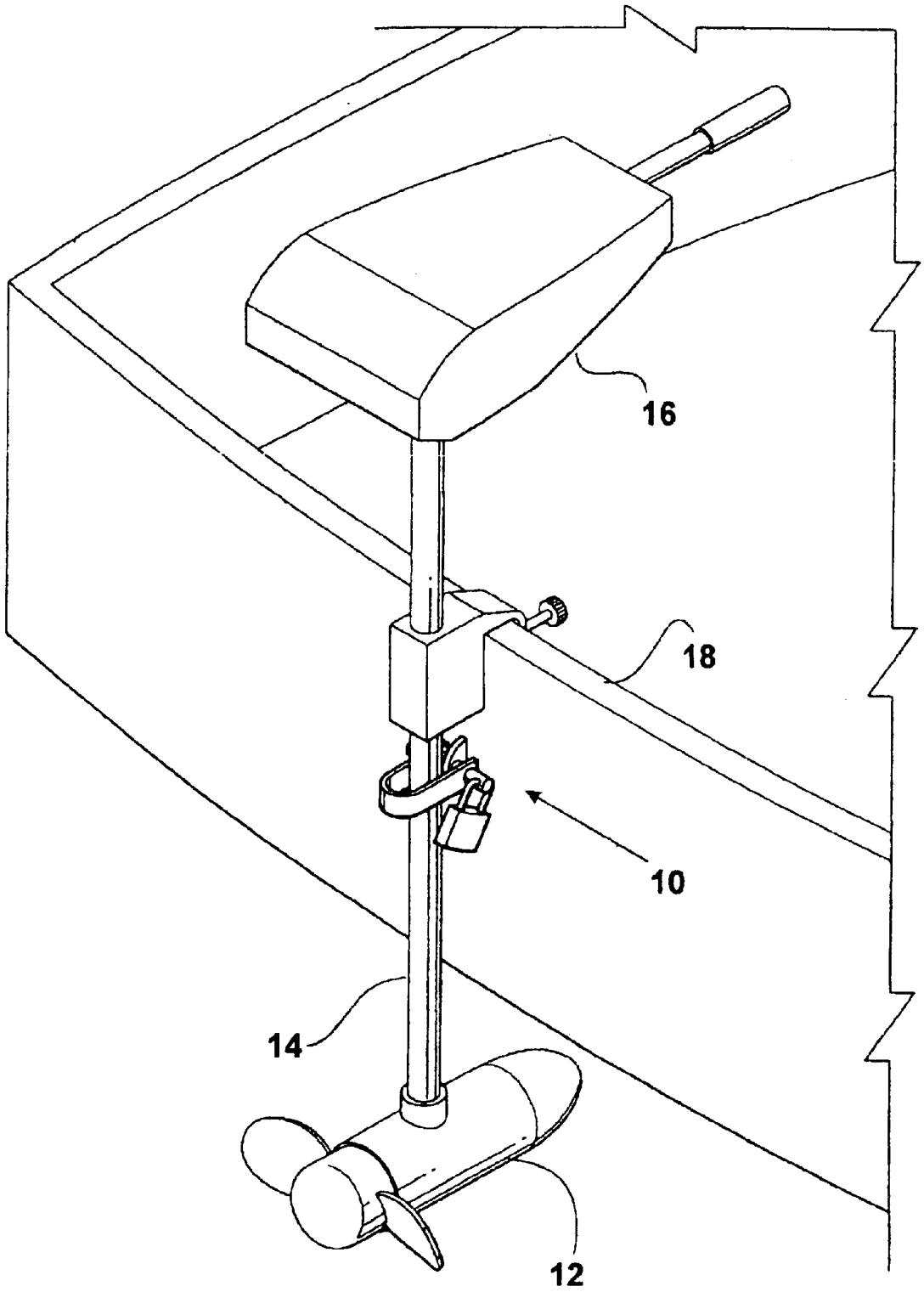
FIG. 1 is an environmental, perspective view of a trolling motor anti-theft device according to the present invention.

Attention is first directed to FIG. 1 which shows the anti-theft device of the instant invention generally at 10. As illustrated, a trolling motor 12 having a shaft 14 and control head 16 is mounted to the transom 18 of a boat as is conventional in the art. Anti-theft device 10 functions to deter unauthorized removal of the motor, shaft and control head from the boat.

Figure 2:
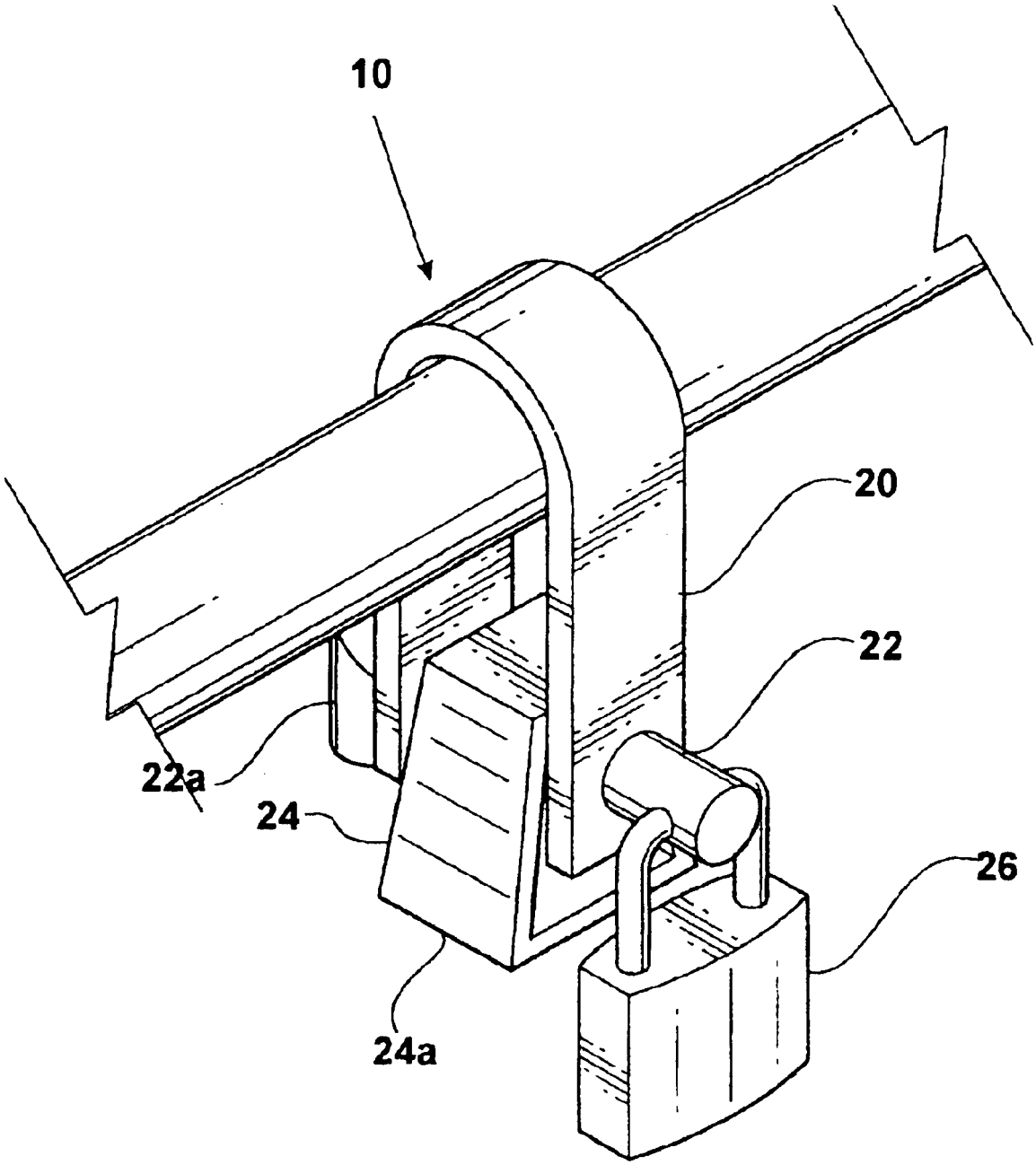
FIG. 2 is a partial, perspective view of the anti-theft device and hasp according to the present invention.
Figure 3:
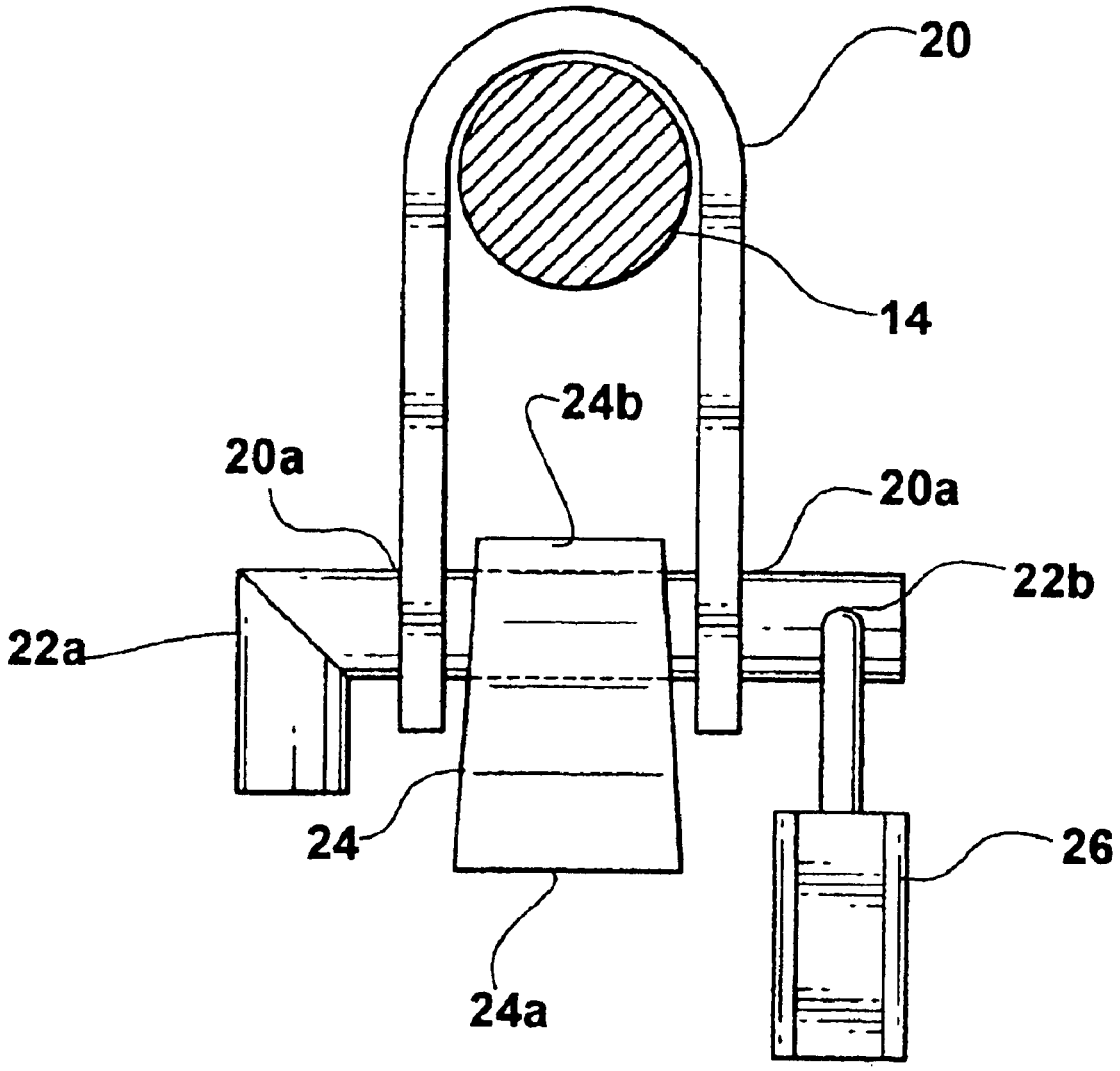
FIG. 3 is a front view of the anti-theft device and hasp according to the present invention.

As best seen in FIGS. 2 and 3, anti-theft device 10 comprises a U-shaped clevis 20, a clevis pin 22, a hasp 24 and a padlock 26. At its distal end 22*a*, pin 22 terminates in an L-shaped configuration. Openings 20*a* are formed through the clevis 20 adjacent each end thereof. An opening 22*b* is formed through the pin adjacent the proximate end thereof. Hasp 24 is adapted to have its base 24*a* securely attached to the deck or hull of the vessel. The attachment may be accomplished in any convenient manner (screws, rivets, pins, etc.). Hasp 24 is solid except for an opening 24*b* formed therethrough.

To secure the trolling motor to the vessel a user would merely position clevis 20 to encompass shaft 14. The ends of the clevis would lie adjacent opposite faces of hasp 24 so that the openings 20*a* in the clevis and opening 24*b* in the hasp are in axial alignment. Pin 22 would then be inserted through the aligned openings. L-shaped end 22*a* would prevent the pin from being entirely inserted through the hasp. Positioning and locking the padlock 26 in pin 22 would effectively secure the trolling motor to the vessel and deter unauthorized removal therefrom.

Figure 4:
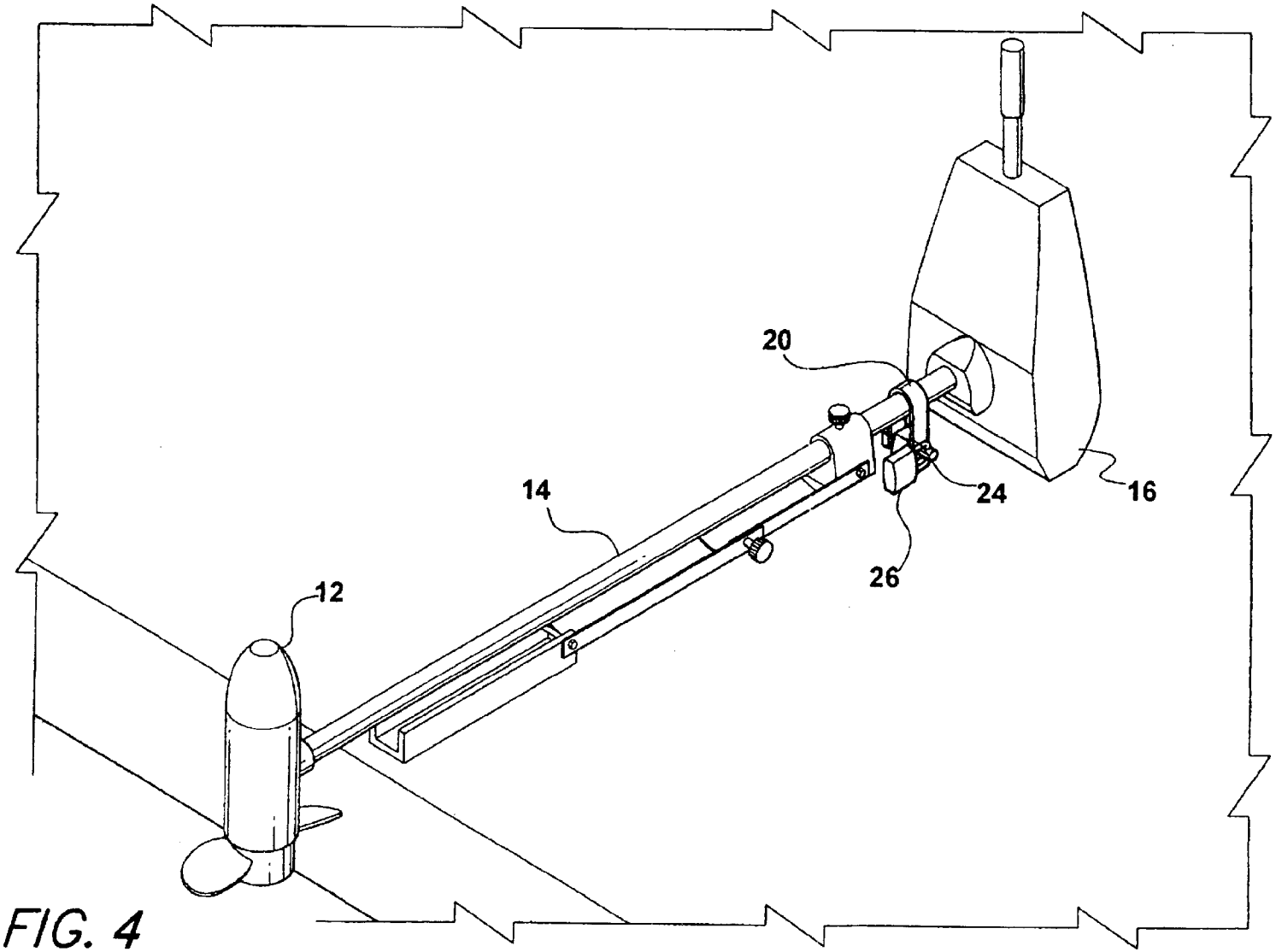
FIG. 4 is a partial, perspective view of a trolling motor in storage position wherein the anti-theft device is attached to the deck of the vessel according to the present invention.

In FIG. 4 the motor is shown in storage position on the deck of the vessel and hasp 24 is attached to the deck.

Figure 5:
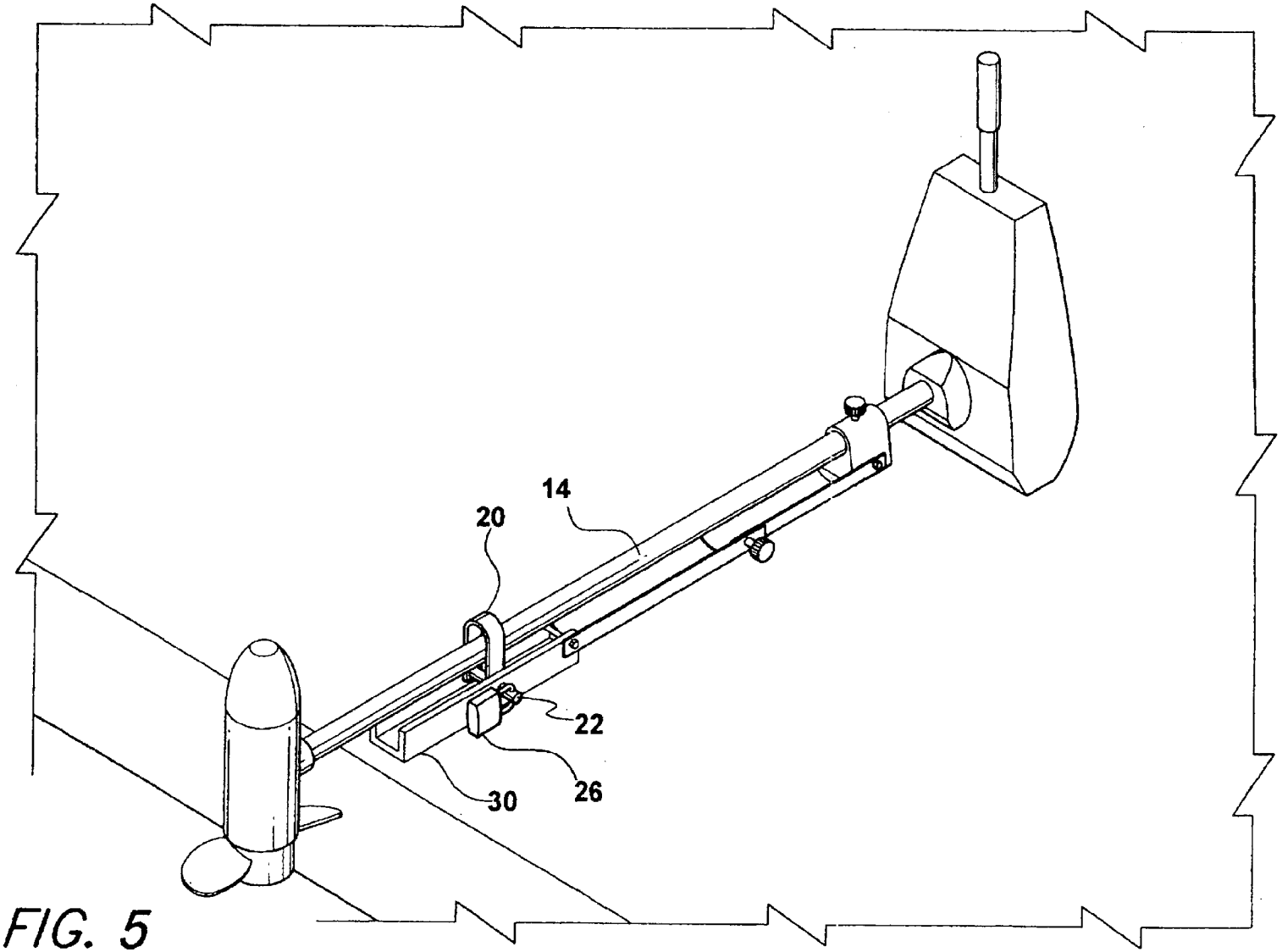
FIG. 5 is a partial, perspective view of a trolling motor in storage position wherein the anti-theft device is attached to a conventional motor mount according to the present invention.
Figure 6:
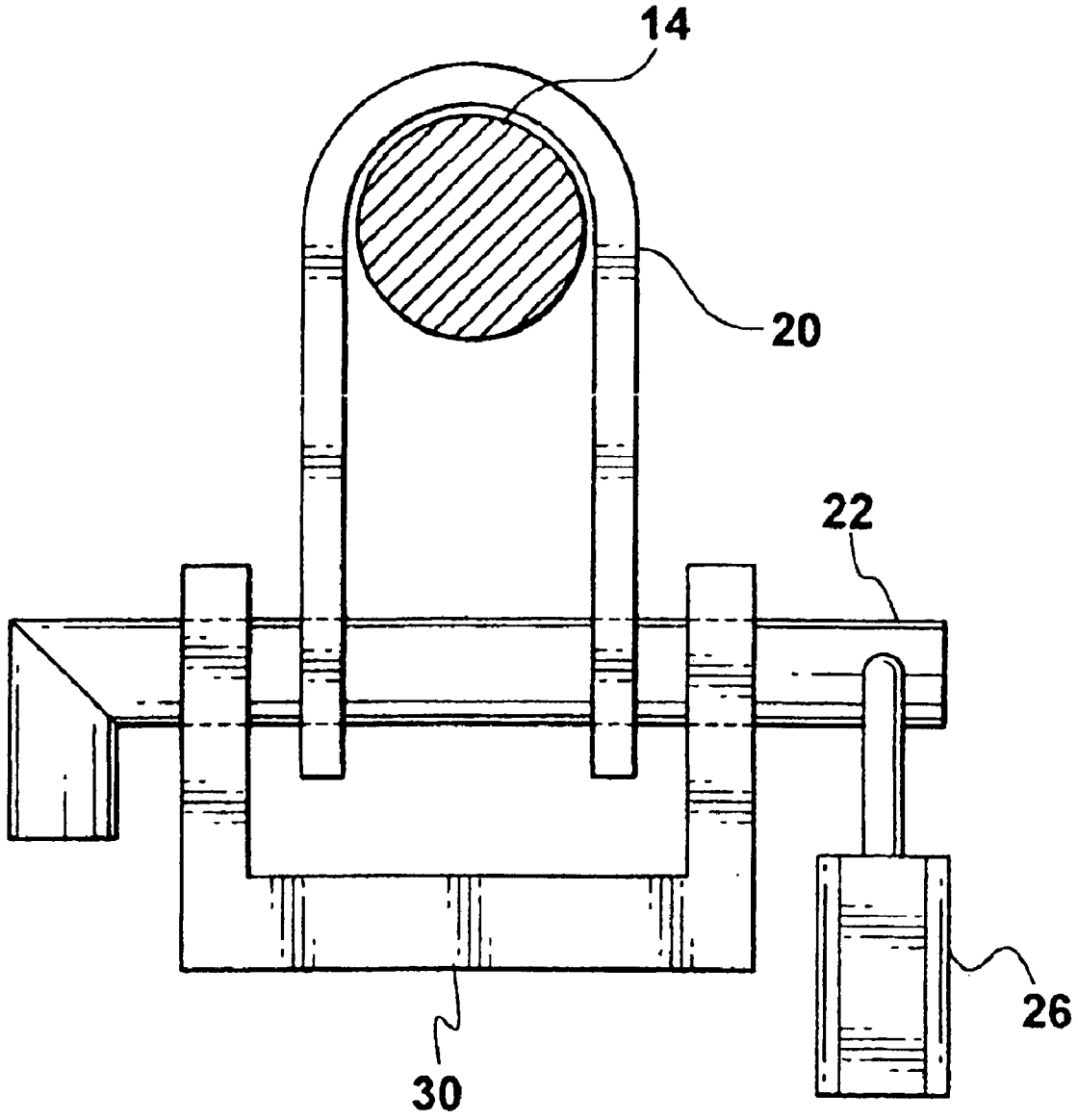
FIG. 6 is a front view of the anti-theft device attached to a conventional motor mount according to the present invention.

FIGS. 5 and 6 illustrate an embodiment wherein the clevis and pin may be attached directly to the body of a conventional trolling motor mount 30. In this instance no hasp is required.

In a preferred form the clevis member, clevis pin and hasp are fabricated from durable metal stock. However it is recognized that a plastic material may be utilized if suitable.

It is to be understood that the present invention is not limited to the embodiments described above, but encompasses any and all embodiments within the scope of the following claims.

I claim:

1. In a marine vessel having a trolling motor mounted thereon, said trolling motor having a shaft, an anti-theft device comprising:

a U-shaped clevis member, said U-shaped clevis member having a first end and a second end, said U-shaped clevis member disposed to encompass said shaft;

openings disposed through said U-shaped clevis member adjacent said first end and said second end;

a hasp mounted on said marine vessel, said hasp having an opening formed therethrough, wherein said openings disposed through said clevis member are positioned adjacent said opening in said hasp;

a clevis pin, said clevis pin having a distal end and a proximate end, said clevis pin disposed through said openings in said clevis member and said opening in said hasp;

an opening defined through said clevis pin adjacent said proximate end; and a padlock disposed in said opening defined through said clevis pin.

2. In a marine vessel as recited in claim 1, wherein the distal end of said clevis pin is of an L-shaped configuration.

3. In a marine vessel as recited in claim 1, wherein said clevis member, said clevis pin and said hasp are fabricated from durable metallic stock.

* * * * *